US005181388A

United States Patent [19]

Abraham

[11] Patent Number: 5,181,388

[45] Date of Patent: Jan. 26, 1993

[54] REFRIGERANT RECOVERY UNIT WITH PURE SYSTEM

[75] Inventor: Anthony W. Abraham, Arlington, Tex.

[73] Assignee: Wynn's Climate Systems, Inc., Ft. Worth, Tex.

[21] Appl. No.: 787,833

[22] Filed: Nov. 5, 1991

[51] Int. Cl.[5] ..... F25B 45/00

[52] U.S. Cl. ..... 62/77; 62/292; 62/303; 62/475; 62/85

[58] Field of Search ..... 62/85, 77, 149, 292, 62/475, 303

[56] References Cited

U.S. PATENT DOCUMENTS 4,476,688 10/1984 Goddard .
5,036,675 8/1991 Anderson, Jr. ..... 62/475
5,040,382 8/1991 Abraham .
5,117,641 6/1992 Keltner ..... 62/292

*Primary Examiner*—John Sollecito
*Attorney, Agent, or Firm*—James E. Bradley

[57] ABSTRACT

A refrigerant recovery apparatus has a feature for purging an air conditioning system component for cleaning. The air conditioning component will be connected into the recovery unit at a point where it will receive liquid refrigerant from the recovery unit. This liquid refrigerant comes from the storage container, with pressure being maintained by the use of the compressor. The air conditioning component connects to a purge container, which is separate from the storage container. The purge container has an outlet leading to an expansion valve for converting the purged refrigerant into a vapor. The vapor refrigerant leads back to a suction end of the recovery unit.

13 Claims, 2 Drawing Sheets

REFRIGERANT RECOVERY UNIT WITH PURE SYSTEM

BACKGROUND OF THE INVENTION

1. Field of the Invention

This invention relates in general to the recovery units for recovering refrigerant from an air conditioning system to be repaired, and in particular to such a unit having features for purging components of the air conditioning system for cleaning.

2. Description of the Prior Art

Environmental regulations now restrict the venting of refrigerant gas to the atmosphere. Repairmen working on air conditioning systems of vehicles, houses and buildings, will be required to recover the refrigerant from the system rather than simply bleeding it off to atmosphere.

Recovery units are available. A typical recovery unit has a compressor, an evaporator, and a condenser. The compressor will draw refrigerant from the air conditioning system, where it passes to an expansion valve in an evaporator to convert all of the refrigerant into a vapor. The compressor will compress the vapor, which then condenses into a liquid at the condenser. The liquified refrigerant will be stored in a tank. Typical recovery units also have means for recycling the refrigerant through a filter dryer to clean the refrigerant.

At times, it is desirable to purge components of the air conditioning system of contaminants. This has been accomplished by flowing liquid refrigerant through the component. A means to return the liquid refrigerant is required. To applicant's knowledge, existing recovery units do not have purging abilities. One patent shows a recovery unit using air compressed by the compressor to flow through the air conditioning component to purge it.

SUMMARY OF THE INVENTION

In this invention after recovery, the air conditioner component to be purged is connected to the liquid port of the recovery unit. The opposite connection of the air conditioner component is connected to an external purge container or tank. The purge container outlet connects to a pressure expansion valve that leads back to the suction or vapor inlet of the recovery unit.

To purge a system, the recovery unit compressor operates to draw liquid from the recovery unit storage container, pass it through a filter dryer and out the liquid port to the air conditioner component. The refrigerant flows through the air conditioner component as a liquid, removing contaminants. The purged refrigerant flows through a filter and into the external purge container.

Refrigerant will flow out the external purge container through the purge expansion valve. When flowing through the purge expansion valve, the pressure will drop, converting the refrigerant into a gas. The purge expansion valve is set at a high enough pressure to avoid freezing of the return hose to the vapor inlet of the recovery unit. The recovery unit will process the purged refrigerant with the compressor, condenser and evaporator in the same manner as during recovery.

DETAILED DESCRIPTION OF THE INVENTION

Figure 1:
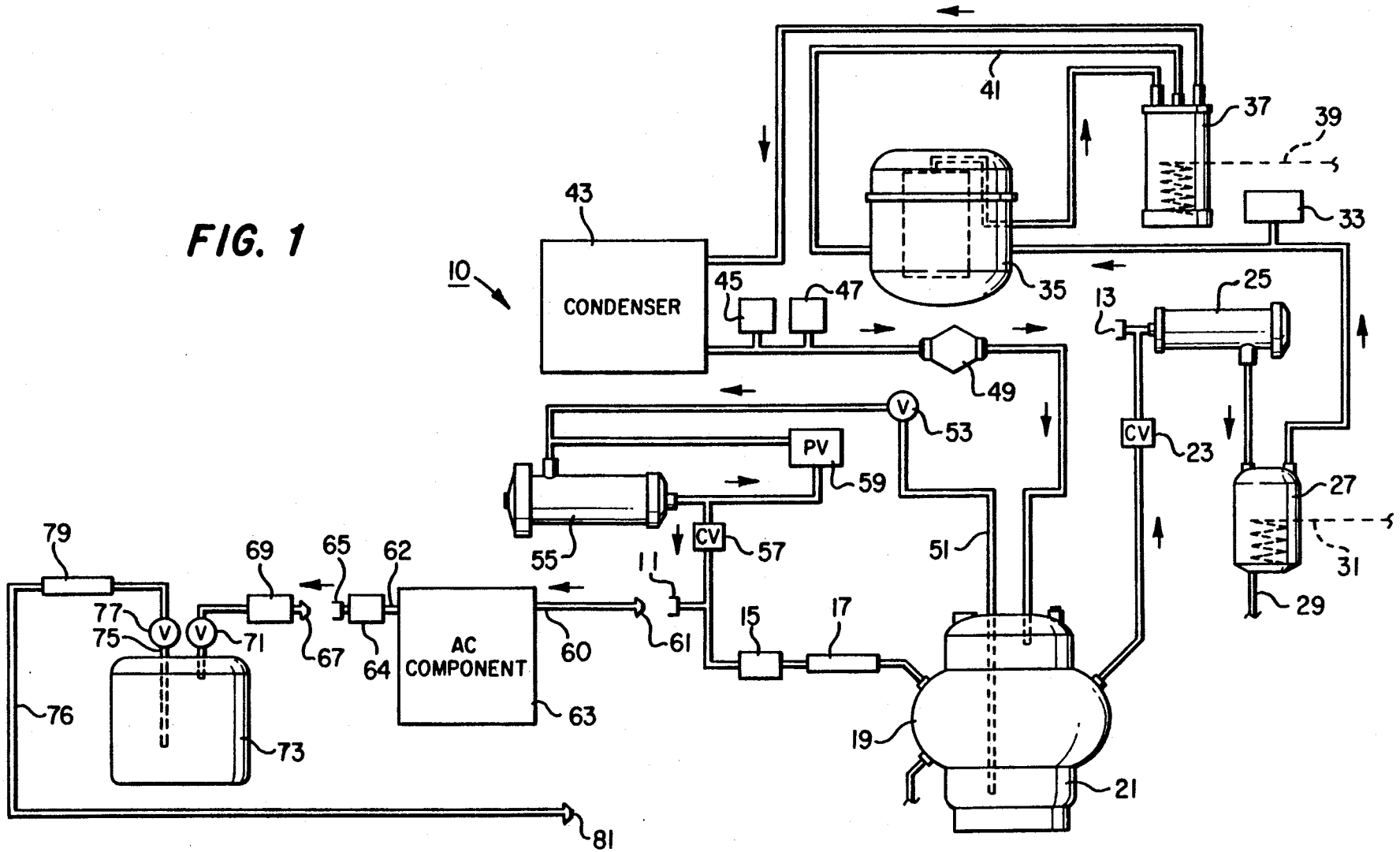
FIG. 1 is a schematic diagram illustrating a recovery unit having a purge system in accordance with this invention.

Referring to FIG. 1, recovery unit 10 has a liquid port 11 and a vapor or suction inlet 13. The liquid port 11 and the vapor inlet 13 are connectors for connecting hoses (not shown) to an air conditioning system (not shown) for recovering the refrigerant from the air conditioning system. The liquid port 11 is also used as an outlet when the recovery unit 10 is used to purge.

Liquid port leads to a filter 15, and from there to an expansion valve 17. Expansion valve 17 is a pressure actuated type, which is set to reduce the pressure of incoming liquid to a selected pressure. The selected pressure is sufficient to cause the liquid refrigerant to convert into a vapor. Preferably, the expansion valve 17 is set to reduce the pressure to about 32 to 34 PSI.

Expansion valve 17 connects to an evaporator chamber 19. Evaporator chamber 19 is a metal annular chamber mounted around storage container 21. Storage container 21 will contain liquid refrigerant which is normally much warmer than the refrigerant in evaporator chamber 19. The refrigerant in storage container 21 will warm the cold vapor in the evaporator chamber 19 to reduce the chances for freezing of the vapor.

Evaporator chamber 19 connects through a check valve 23 to a strainer 25, which further removes contaminates such as metal particles from the refrigerant. The vapor inlet 13 connects between check valve 23 and strainer 25.

Strainer 25 connects to an oil separator or accumulator 27. Accumulator 27 is a metal canister that will allow any liquids to drop out, such as oil or any droplets of liquid refrigerant. Accumulator 27 has an oil drain 29 for removing any oil collected in accumulator 27 A heater coil 31 will apply heat to facilitate the removal of oil collected in accumulator 27.

Accumulator 27 connects to a compressor 35. The inlet to compressor 35 has a low pressure cut off switch 33 which will cut off the compressor 35 if the intake pressure is below a selected minimum. Compressor 35 compresses the refrigerant vapor, passing it to an oil separator 37. Oil separator 37 collects oil droplets in the compressed vapor. A heater element 39 is used to maintain the oil at a warm temperature. The oil will return back to the compressor 35 through a return line 41.

Oil separator 37 leads to a condenser 43. Condenser 43 has a fan (not shown) that blows across it to reduce the temperature of the refrigerant vapor sufficiently to cause it to condense into a liquid. High pressure cutoff switch 45 locates at the outlet of condenser 43 to turn off compressor 35 if the pressure is excessive. Low pressure switch 47 senses the condenser 43 outlet pressure and turns off the fan and turns on the heaters 31, 39 if the pressure is below a selected minimum. The liquified refrigerant passes through a moisture indicator 49 and into the storage container 21.

An outlet 51 leads out of the storage container 21 to a solenoid valve 53 which is in a recycle path or line. Valve 53 will be normally closed while the unit is recovering refrigerant, so that all of the recovered refrigerant will flow into the storage container 21 and remain there until recycling for cleaning is desired.

For recycling, liquid port 11 is disconnected from the air conditioning system, and valve 53 is opened to allow refrigerant to flow out of the storage container 21 for cleaning. From valve 53, the refrigerant flows to a filter dryer 55. Filter dryer 55 leads through a check valve 57 back to the filter 15. A pressure relief valve 59 will allow the refrigerant to bypass the filter dryer 55 if the filter dryer 55 becomes clogged sufficiently to cause the pressure to be excessive.

For purging, a purge line 60 with a connector 61 will be connected to an air conditioning component 63. The air conditioning component 63 may be a condenser, evaporator or other component of the air conditioning system being repaired. The outlet of the air conditioning component 63 connects to a return line 62 that includes a connector 65 and may incorporate a check valve 64. During purging, a purge container connector 67 will connect to the connector 65.

When connectors 67 and 65 are connected together, refrigerant flows through a filter 69, through a manual valve 71 and into a purge container 73. Purge container 73 has the capacity to store refrigerant and may be approximately the same size as recovery unit storage container 21. An outlet 75 leads out of the purge container 73 to a transfer line 76. The transfer line 76 includes a manual valve 77 and an expansion valve 79. Expansion valve 79 is a pressure actuated expansion valve similar to expansion valve 17. However, it is set so that the downstream pressure will be at a higher pressure than the downstream pressure of expansion valve 17. The pressure is preferably set about 38 PSI. This reduces the chances for the refrigerant in the transfer line 76 on the downstream side of expansion valve 79 from freezing. The transfer line 76 has a connector 81 which during purging is connected to the vapor inlet 13.

In operation, first refrigerant will be covered from the air conditioning system (not shown). This is handled by connecting hoses to the liquid port 11 and the vapor inlet 13. Compressor 35 is turned on. Refrigerant will flow into liquid port 11, through filter 15, and through expansion valve 17, where the refrigerant is converted into a gas. The refrigerant vapor flows through evaporator 19 and into strainer 25. Similarly, vapor being withdrawn from the air conditioning system flows in the vapor inlet 13 through strainer 25.

The refrigerant flows through accumulator 27 and is compressed by compressor 35. The refrigerant flows as a warm higher pressure vapor out compressor 35 to condenser 43. Condenser 43 condenses the vapor to a warm liquid. The refrigerant as a warm liquid will flow into the storage container 21. Solenoid valve 53 will be closed.

After the air conditioning system has been evacuated, the recovered refrigerant may be cleaned. This is handled by disconnecting the hoses from the liquid port 11 and vapor inlet 13. Solenoid valve 53 is opened. Compressor 35 is turned on.

Refrigerant will flow as a liquid out outlet 51 and through filter dryer 55 where it is cleaned. The refrigerant flows through filter 15 and expansion valve 17 into evaporator 19. The vapor flows through strainer 25 and accumulator 27 into the compressor 35. The compressor 35 pumps the refrigerant out through the condenser 43, where it flows back into the storage container 21. This process will last a few minutes and will clean the refrigerant.

Figure 2:
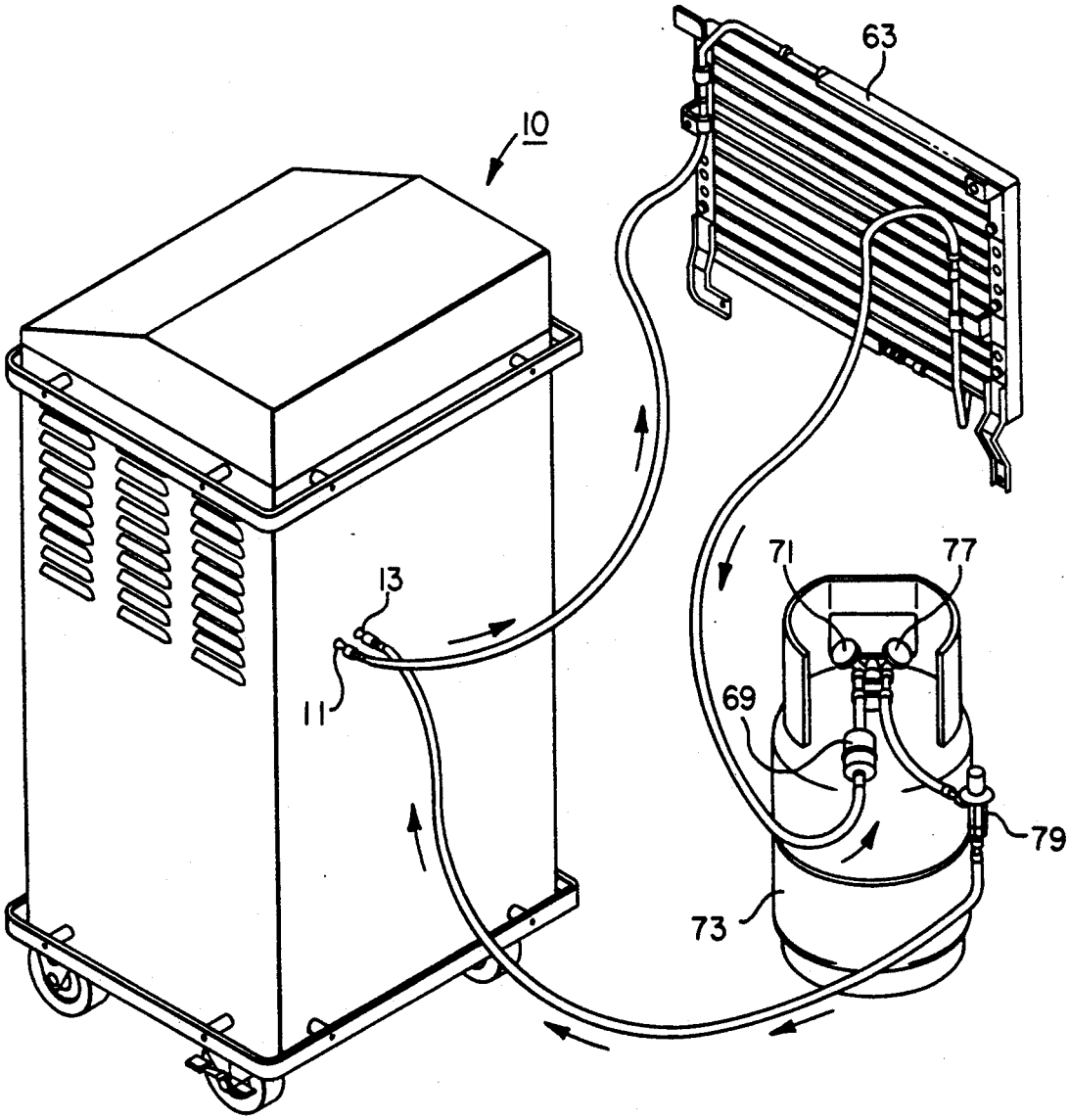
FIG. 2 is a perspective view illustrating a recovery unit, external purge container and an air conditioning component.

Then, the worker may wish to clean certain air conditioning components by purging them. To do this, the operator will connect connector 61 of the purge line 60 to the liquid port 11. The operator connects connector 65 of the return line 62 to connector 67. The operator connects connector 81 of the transfer line 76 to vapor inlet 13. This purge mode is illustrated in FIG. 2.

Solenoid valve 53 will be opened and compressor 35 turned on. Refrigerant will flow out the storage container 21 outlet 51, through the filter dryer 55 and through the liquid port 11 into the air conditioning component. The refrigerant, as a liquid, flows through the air conditioning component 63, through filter 69, and into the purge container 73. The purge container 73 accumulates and stores some of the refrigerant. However, valve 77 will be open during purging, allowing refrigerant to continuously flow out through the expansion valve 79.

The expansion valve 79 converts the liquid refrigerant into a gas. The gas flows through connector 81 into vapor inlet 13. The vapor flows through strainer 25, accumulator 27 and is compressed by compressor 35. The compressed refrigerant passes through the oil separator 37, condenser 43 and back into the storage container 21. Solenoid valve 53 remains open, allowing the purging fluid to continuously flow out outlet 51 to circulate through the air conditioning component 63. After about five minutes, the compressor 35 may be turned off.

The air conditioning component 63 will contain some of the purged refrigerant after the purging has been completed. This purged refrigerant is clean, but must be evacuated. Connector 61 may remain connected to liquid port 11. To recover, the transfer line connector 81 will be disconnected from the vapor inlet 13, or alternately, the valve 77 will be closed. The compressor 35 will be turned on and valve 53 will be closed. The liquid in the air conditioner component 63 will now flow back in the liquid port 11, through filter 15 and expansion valve 17 into the evaporator 19. Check valve 64 prevents the refrigerant form flowing out of purge container 73 back into the air conditioning component 63. Compressor 35 will compress the recovered purged refrigerant, pass it through condenser 43 and back into storage container 21. Once the refrigerant has been recovered from the component 63, the component 63 may be completely disconnected.

The next step is to clean the purged refrigerant contained in the purge container 73. This is handled by connecting connector 81 to vapor inlet 13. Connector 67 connects to liquid port 11. Solenoid valve 53 is opened. The compressor 35 will now pump liquid refrigerant out outlet 51, through filter dryer 55, and through filter 69 into the purge container 73. The refrigerant flows through the expansion valve 79 and back into the vapor inlet 13. The refrigerant will be cycled back into the storage container 21. This process will be continued until the purged refrigerant is cleaned. The refrigerant in the purge container 73 may be subsequently used for recharging the air conditioning system once it has been repaired.

The invention has significant advantages. The purge system allows liquid refrigerant to be pumped through air conditioning components for cleaning. The purge refrigerant is recovered and cleaned for reuse. The external tank and expansion valve avoid freezing of refrigerant being cycled through the air conditioning component.

While the invention has been shown in only one of its forms, it should be apparent to those skilled in the art that it is not so limited, but is susceptible to various changes without departing from the scope of the invention.

I claim:

1. In a refrigerant recovery apparatus for recovering refrigerant from an air conditioning system, the apparatus having an inlet adapted to be connected to the air conditioning system, a recovery expansion valve for converting any liquid refrigerant received in the inlet from the air conditioning system into a gaseous refrigerant, an evaporator for adding heat to the gaseous refrigerant received from the recovery expansion valve, a compressor for compressing the gaseous refrigerant received from the evaporator, a condenser for condensing the compressed gaseous refrigerant into a liquid refrigerant and delivering the liquid refrigerant to a storage container, an improved means for purging components of the air conditioning system for cleaning, comprising in combination:

connection means in a refrigerant flow path of the recovery apparatus between the condenser and the recovery expansion valve for directing a flow of refrigerant drawn from the storage container, compressed by the compressor and condensed by the condenser to a component of the air conditioning system;

a purge fluid container; and means connected to the component of the air conditioning and extending to the purge fluid container for receiving the refrigerant in the purge fluid container after flowing through the component of the air conditioning system.

2. The apparatus according to claim further comprising:

transfer means for transferring the refrigerant stored in the purge fluid container back to the storage container.

3. The apparatus according to claim further comprising:

a transfer line leading from the purge storage container to a refrigerant flow path in the recovery apparatus between the recovery expansion valve and the compressor; and a purge expansion valve in the transfer line for reducing the pressure of the refrigerant flowing through the transfer line and converting the refrigerant to a gaseous refrigerant.

4. The apparatus according to claim further comprising:

a recycle line leading from the storage container back to an input of the recovery expansion valve;

a filter dryer in the recycle line;

valve means for selectively opening the recycle line to allow refrigerant from the storage container to flow through the filter dryer for cleaning, through the recovery expansion valve, evaporator, compressor and condenser to return to the storage container;

a transfer line leading from the purge storage container to a refrigerant flow path in the recovery apparatus between the recovery expansion valve and the compressor so that the refrigerant from the purge fluid container will flow through the condenser, into the storage container and out through the recycle line for cleaning; and a purge expansion valve in the transfer line for reducing the pressure of the refrigerant flowing through the transfer line and converting the refrigerant to a gas.

5. In a refrigerant recovery apparatus for recovering refrigerant from an air conditioning system, the apparatus having an inlet adapted to be connected to the air conditioning system, a recovery expansion valve for converting any liquid refrigerant received in the inlet from the air conditioning system into a gaseous refrigerant, an evaporator for adding heat to the gaseous refrigerant received from the recovery expansion valve, a compressor for compressing the gaseous refrigerant received from the evaporator, a condenser for condensing the compressed gaseous refrigerant into a liquid refrigerant and delivering the liquid refrigerant to a storage container, a recycle line leading from the storage container back to an input of the recovery expansion valve, a filter dryer in the recycle line, recycle valve means for selectively opening the recycle line to allow refrigerant from the storage container to flow through the filter dryer for cleaning, through the recovery expansion valve, evaporator, compressor and condenser to return to the storage container, an improved means for purging components of the air conditioning system for cleaning, comprising in combination:

a purge line having connection means on one end for connecting the purge line to a refrigerant flow path of the recovery apparatus in the recycle line between the filter dryer and the recovery expansion valve and connection means on another end for connecting the purge line to a component of the air conditioning system, so that when the recycle valve means is open, refrigerant will flow from the recycle line to the component of the air conditioning system;

a purge fluid container;

a return line having connection means for connecting the component of the air conditioning system to the purge fluid container for receiving the refrigerant in the purge fluid container after flowing through the component of the air conditioning system;

a transfer line having connection means for connecting the purge storage container to a refrigerant flow path in the recovery apparatus between the recovery expansion valve and the compressor, so that the refrigerant returning from the purge fluid container will flow through the condenser, into the storage container and thence through the filter dryer for cleaning; and a purge expansion valve in the transfer line for reducing the downstream pressure of the refrigerant through the transfer line and converting the refrigerant to a gas.

6. The apparatus according to claim 5 wherein the recovery expansion valve is set to provide a selected reduced downstream pressure and the purge expansion valve is set to provide a selected reduced downstream pressure that is higher than the downstream pressure provided by the recovery expansion valve.

7. In a method for recovering refrigerant from an air conditioning system, comprising the steps of connecting the air conditioning system to a recovery expansion valve, converting any liquid refrigerant received from the air conditioning system into a gaseous refrigerant, evaporating the gaseous refrigerant, compressing the gaseous refrigerant after evaporation, condensing the compressed gaseous refrigerant into a liquid refrigerant and delivering the liquid refrigerant to a storage container, an improved method for purging components of the air conditioning system for cleaning, comprising:

operating the compressor and directing a flow of refrigerant drawn from the storage container, and condensed by the condenser to a component of the air conditioning system; and receiving the refrigerant flowing through the component of the air conditioning system in a purge fluid container.

8. The method according to claim 7, further comprising:

transferring the refrigerant contained in the purge fluid container back to a flow path between the compressor and the condenser.

9. The method according to claim 7, further comprising:

flowing refrigerant contained in the purge fluid container out through a purge expansion valve, converting the refrigerant into a gaseous refrigerant; and transferring the gaseous refrigerant flowing from the purge fluid container back to an intake of the compressor.

10. The method according to claim 7, further comprising:

disconnecting the component of the air conditioning system from the purge fluid container and from the flow from the condenser;

providing a filter dryer in a recycle line extending from the storage container to the recovery expansion valve;

operating the compressor and directing a flow of refrigerant drawn from the storage container, and condensed by the condenser through the recycle line and from the recycle line downstream of the filter dryer to the purge fluid container, bypassing the component of the air conditioning system;

flowing refrigerant contained in the purge fluid container out through a purge expansion valve, converting the refrigerant into a gaseous refrigerant; and transferring the gaseous refrigerant flowing from the purge fluid container back to an intake of the compressor, compressing, condensing and circulating the refrigerant through the filter dryer for cleaning.

11. In a method for recovering refrigerant from an air conditioning system, comprising the steps of connecting the air conditioning system to a recovery expansion valve, converting any liquid refrigerant received from the air conditioning system into a gaseous refrigerant, evaporating the gaseous refrigerant, compressing the gaseous refrigerant after evaporation, condensing the compressed gaseous refrigerant into a liquid refrigerant and delivering the liquid refrigerant to a storage container, providing a filter dryer in a recycle line extending from the storage container to the recovery expansion valve, an improved method for purging components of the air conditioning system for cleaning, comprising:

operating the compressor and directing a flow of refrigerant drawn from the storage container, and condensed by the condenser through the filter dryer in the recycle line and to a component of the air conditioning system;

receiving the refrigerant flowing through the component of the air conditioning system in a purge fluid container;

after purging has been completed, disconnecting the component of the air conditioning system from the purge fluid container and from the flow from the recycle line; then operating the compressor and directing a flow of refrigerant drawn from the storage container, and condensed by the condenser through the recycle line and from the recycle line downstream of the filter dryer to the purge fluid container, bypassing the component of the air conditioning system; then flowing refrigerant contained in the purge fluid container out through a purge expansion valve, converting the refrigerant into a gaseous refrigerant; and transferring the gaseous refrigerant flowing from the purge fluid container back to a intake of the compressor, compressing, condensing and circulating the refrigerant through the filter dryer for cleaning.

12. A method for recovering refrigerant from an air conditioning system and purging a component of the air conditioning system for cleaning, comprising:

connecting the air conditioning system to a recovery expansion valve;

providing a reduced downstream pressure with the recovery expansion valve to covert any liquid refrigerant received from the air conditioning system into a gaseous refrigerant;

evaporating the gaseous refrigerant;

compressing the gaseous refrigerant after evaporation;

condensing the compressed gaseous refrigerant into a liquid refrigerant and delivering the liquid refrigerant to a storage container; then, after the refrigerant has been recovered, withdrawing refrigerant from the storage container for cleaning, passing the refrigerant through a filter dryer, evaporating the refrigerant, compressing the refrigerant, condensing the refrigerant, and returning the refrigerant to the storage container; then, after the refrigerant has been cleaned, operating the compressor and directing a flow of refrigerant drawn from the storage container, and condensed by the condenser to a component of the air conditioning system;

receiving the refrigerant flowing through the component of the air conditioning system in a purge fluid container;

flowing the refrigerant from the purge fluid container through a purge expansion valve and providing a reduced downstream pressure with the purge expansion valve to convert the refrigerant to a gaseous refrigerant, then flowing the gaseous refrigerant back to an intake of the compressor; and compressing, condensing, and placing the refrigerant from the purge expansion valve in the storage container; then withdrawing the refrigerant from the storage container and circulating the refrigerant through the filter dryer for cleaning.

13. The method according to claim 12 wherein the reduced downstream pressure provided by the purge expansion valve is greater than the reduced downstream pressure provided by the recovery expansion valve.

* * * * *

UNITED STATES PATENT AND TRADEMARK OFFICE

CERTIFICATE OF CORRECTION

PATENT NO. : 5,181,388

DATED : 1/26/93

INVENTOR(S) : Anthony W. Abraham

It is certified that error appears in the above-identified patent and that said Letters Patent is hereby corrected as shown below:

On the title page, item [54] and in column 1, line 2, in the title, "PURE" should be --PURGE--.

Signed and Sealed this

Thirtieth Day of November, 1993

*Attest:*

*Attesting Officer*

BRUCE LEHMAN

*Commissioner of Patents and Trademarks*